US005692427A

United States Patent [19]

Yoshida et al.

[11] Patent Number: 5,692,427

[45] Date of Patent: Dec. 2, 1997

[54] FLOW REINFORCEMENT DIRECTIONAL CONTROL VALVE FOR A HYDRAULIC CIRCUIT

[75] Inventors: Nobumi Yoshida; Tadao Karakama; Nobuhisa Honda, all of Kanagawa, Japan

[73] Assignee: Komatsu Ltd., Japan

[21] Appl. No.: 583,020

[22] PCT Filed: Aug. 11, 1994

[86] PCT No.: PCT/JP94/01335

§ 371 Date: Jan. 19, 1996

§ 102(e) Date: Jan. 19, 1996

[87] PCT Pub. No.: WO95/05546

PCT Pub. Date: Feb. 23, 1995

[30] Foreign Application Priority Data

Aug. 12, 1993 [JP] Japan ..... 5-200673
Aug. 12, 1993 [JP] Japan ..... 5-200695

[51] Int. Cl.[6] ..... F01B 25/02

[52] U.S. Cl. ..... 91/6; 91/28; 91/524; 91/529; 137/596.18

[58] Field of Search ..... 91/526, 529, 530, 91/531, 28, 469, 6, 524; 137/596.14, 596.18

[56] References Cited

U.S. PATENT DOCUMENTS 4,492,251 1/1985 Blake ..... 137/596.18
4,729,408 3/1988 Coutant ..... 137/596.18
4,763,691 8/1988 Hahmann ..... 137/596.18
4,924,902 5/1990 Lewis et al. ..... 137/596.18

FOREIGN PATENT DOCUMENTS 55-45023 3/1980 Japan .
60-26729 2/1985 Japan .
4134969 12/1992 Japan .

*Primary Examiner*—F. Daniel Lopez
*Attorney, Agent, or Firm*—Ronald P. Kananen

[57] ABSTRACT

A flow reinforcement directional control valve that is capable of reinforcing a pressure fluid to two actuators, can be formed as compact and yet is capable of flowing a return fluid out of a single actuator into a tank is provided, wherein a valve block 20 has a spool bore 21 in which a first spool (22) and a second spool (23) are slidably inserted; in which the first spool (22) is adapted to be held at a neutral position thereof by a first spring (36) and to be displaced by a pressure fluid in a second pressure receiving chamber (47) to a position thereof for supplying the fluid to an actuator; and in which the above mentioned second spool (23) is adapted to be held at a neutral position thereof by a second spring (41) and to be displaced by a pressure fluid in a first pressure receiving chamber (42) to a position thereof for flowing a return fluid into a tank and to be displaced by a pressure fluid in a third pressure receiving chamber (52) to a position thereof for supplying a pressure fluid to an actuator.

10 Claims, 6 Drawing Sheets

FLOW REINFORCEMENT DIRECTIONAL CONTROL VALVE FOR A HYDRAULIC CIRCUIT

TECHNICAL FIELD

The present invention relates to a flow reinforcement directional control valve for supplying a pressurized discharge fluid from a hydraulic pump to a plurality of actuators to enable each of them to operate at a high speed. The invention may be used in a pressurized fluid supply unit in which a pressurized discharge fluid from a hydraulic pump is supplied to such a plurality of actuators via a plurality of directional control valves, respectively.

BACKGROUND ART

As a pressurized fluid supply unit for supplying a pressurized discharge fluid from a hydraulic pump, there has hitherto been known an apparatus In which a plurality of directional control valves are provided in a discharge path of the hydraulic pump to supply the pressurized discharge fluid to a plurality of actuators, respectively. For example, a power shovel hydraulic circuit has been used in which a boom cylinder, an arm cylinder, a bucket cylinder, a turning motor, and a right hand side and a left hand side traveling motor are supplied with the pressurized fluid via a directional control valve for boom, a directional control valve for arm, a directional control valve for bucket, and a right hand side and a left hand side traveling purpose directional control valve that are provided in the discharge path of the hydraulic pump.

In order to satisfy a common specification, such directional control valves as used in such a hydraulic circuit should be of an identical size, and a maximum flow that can be supplied to each such individual actuator should be identical in order to make a maximum operating speed thereof identical. Accordingly, where a particular actuator is to be operated at a high speed, it has been a practice that a large volumetric flow is supplied to the particular actuator by providing a flow reinforcement directional control valve in association therewith.

For example, since in the above mentioned hydraulic circuit for a power shovel, a boom cylinder and an arm cylinder need to be operated at a high speed, it has been a practice that a flow reinforcement directional control valve for boom and a flow reinforcement directional control valve for arm are arranged in parallel to a directional control valve for boom and the directional control valve for arm to ensure that a large volumetric flow can be supplied to the boom cylinder and the arm cylinder.

If a particular actuator is to be supplied with a large volumetric flow as mentioned above, the same number of flow reinforcement directional control valves are required as the number of such particular actuators. Also, such flow reinforcement directional control valves must each have a spool slidably inserted in a valve block. Therefore, it will follow that the number of such valve blocks is increased with the result that an overall pressurized fluid supply unit must be large-sized, thus enlarging a space for it to be installed.

At this point, it should be noted that a valve has hitherto been known, as disclosed in Japanese Unexamined Utility Model Publication No. Hei 04-134969, in which a pair of spools are slidably inserted in a single valve block and the movements of these two spools may bring about the controlled opening and closing of a pair of circuits. Note, however, there that since such a valve has the two spools each energized by a spring in a single direction and has adopted a construction in which they are each thrusted in the opposite direction under a pilot pressure applied against the spring, the valve has only a function to cause the pressurized fluid either to flow or not to flow with a circuit opened or closed, respectively.

For this reason, if the above mentioned valve is used as a flow reinforcement directional control valve for boom or a flow reinforcement directional control valve for arm, it will only function either to enable or to disable the pressurized fluid to be supplied to the boom cylinder or the arm cylinder; it will have no function for a flow to be returned.

To make the matter worse, since a return fluid from an actuator Is passed through the meter-out opening of a directional control valve to flow out into a tank, an increase in the return fluid from the actuator will cause the passage resistance to be enlarged and the back pressure there to be elevated. Hence, an increased hydraulic horse power and an augmented circuit loss will ensue.

For example, where the arm cylinder which has its contracting chamber supplied with a pressurized fluid is contractively operated, the return fluid from its expanding chamber will be increased, thereby causing an increased back pressure there and in turn an increased driving pressure there accordingly.

SUMMARY OF THE INVENTION

It is, therefore, an important object of the present invention to provide a flow reinforcement directional control valve for a hydraulic circuit, which valve is capable of selectively applying a fluid pressure to a plurality of hydraulic loads and of making a valve block compact.

Another object of the present invention is to provide a flow reinforcement directional control valve for a hydraulic circuit, which valve is capable of allowing a return fluid from a particular hydraulic load, among a plurality of hydraulic loads, to be flushed out into a tank, and yet of flushing a large volumetric flow out of such a particular hydraulic load into a fluid pressure source, thereby smoothening an operation of the particular hydraulic load.

In order to attain the objects mentioned above, there is provided in accordance with the present invention, in a first construction thereof, a flow reinforcement directional control valve which is so constructed that a valve block may have a spool bore in which at a left hand side and at a right hand side thereof a first spool and a second spool are slidably inserted, respectively; which at an intermediate portion thereof between the said left hand and right hand sides is formed an intermediate port to form with a first pressure receiving chamber positioned between opposing end surfaces of the said first and second spools; which is formed with a first pump port and a first actuator port that are adapted to be connected to and disconnected from each other by the said first spool; which is formed with a second pump port, a second actuator port and a second tank port that are adapted to be connected to and disconnected from one another by the said second spool;

in which spool bore the said first spool is adapted to be held at a neutral position thereof by a first spring for blocking a communication between the said ports, and to be displaced to a first position thereof by a pressurized fluid in a second pressure receiving chamber for establishing a communication between the said first pump port and the said first actuator port while communicating the said first pressure receiving chamber with a left hand end chamber of the said first spool so that the said spool may not be influenced by a pressure in the said first pressure receiving chamber; and in which spool bore the said second spool is adapted to be held at a neutral position thereof by a second spring for blocking a communication between the said ports, to be displaced to a first position thereof by a pressurized fluid in a third pressure receiving chamber for establishing a communication between the said second pump port and the said second actuator port while blocking a communication between the said second actuator port and the said second tank port, and to be displaced to a second position thereof by a pressurized fluid in the said first pressure receiving chamber for establishing a communication between the said second actuator port and the said second tank port while blocking a communication between the said second actuator port and the said second pump port.

The present invention also provides, in a second construction thereof, a flow reinforcement directional control valve which is so constructed that a valve block may have a spool bore in which at a left hand side and at a right hand side thereof a first spool and a second spool are slidably inserted, respectively; which is formed with a first pump port and a first actuator port that are adapted to be connected to and disconnected from each other by the said first spool; which is formed with a second pump port, a second actuator port and a second tank port that are adapted to be connected to and disconnected from one another by the said second spool;

in which spool bore the said first spool is adapted to be held by a first spring disposed at one end portion of the said left hand and right hand sides at a neutral position thereof for blocking a communication between the said ports, and to be displaced by a pressurized fluid in a first pressure receiving chamber formed at a side of the said first spring to a first position thereof for establishing a communication between the said first pump port and the said first actuator port; and in which spool bore the said second spool is adapted to be held by a spring disposed at the other end portion of the said left hand and right hand sides at a neutral position thereof for blocking a communication between the said ports, to be displaced by a pressurized fluid in a second pressure receiving chamber formed at a side of the latter spring to a first position thereof for establishing a communication between the said second pump port and said second actuator port while blocking a communication between the said second actuator port and the said second tank port, and to be displaced by a pressurized fluid in a third pressure receiving chamber formed at a side of the said latter spring to a second position thereof for establishing a communication between the said second actuator port and the said second tank port while blocking a communication between the said second actuator port and the said second pump port.

At this point, it should be noted that the valve may be made capable of establishing and blocking a communication between a said pump port and a said actuator port and a communication between a said actuator port and a said tank port, together with the said first spool and the said second spool.

The present invention further provides, in a third construction thereof, a directional control valve for reinforcing the flow of an operating fluid in a hydraulic circuit which is provided between a fluid pressure source on the one hand and a first and a second hydraulic load on the other hand for feeding and draining the operating fluid between the fluid pressure source and the hydraulic loads, the flow reinforcement directional control valve in the hydraulic circuit comprising:

a valve block having a spool bore that is formed with a first inlet port and a second inlet port which are connected to the said fluid pressure source, a first outlet port which is connected to the said first hydraulic load and positioned adjacent to the said first inlet port, a second outlet port which is connected to the said second hydraulic load and positioned adjacent to the said second inlet port and a drain port for returning a flow of the operating fluid to the said fluid pressure source;

a first spool that is slidably inserted into the said spool bore from a first end portion of the said spool bore for selectively establishing and blocking a communication between the said first inlet port and the said first outlet port;

a second spool that is slidably inserted into the said spool bore from a second end portion of the said spool bore for selectively establishing and blocking a communication between the said second inlet port and the said second outlet port;

a first spring for tending to urge the said first spool to take a neutral position thereof for regularly blocking a communication between the said first inlet port and the said first outlet port;

a first pressure receiving chamber that is formed by side of an end surface of the said first spool and, when supplied with a pressurized fluid, is adapted to urge the said first spool to take a position of communication thereof for establishing a communication between the said first inlet port and the said first outlet port;

a second spring for tending to urge the said second spool to take a neutral position thereof for regularly blocking a communication between the said second inlet port and the said second port;

a second pressure receiving chamber that is formed by the side of an end surface of the said second spool and, when supplied with a pressurized fluid, is adapted to urge the said second spool to take a position of pressurized fluid supply thereof for establishing a communication between the said second inlet port and the said second outlet port while blocking a communication between the said second outlet port and the said drain port; and a drive means that is adapted to drive the said second spool to take a position of drain thereof for blocking a communication between the said second inlet port and the said second outlet port while establishing a communication between the said second outlet port and the said drain port.

In the construction set forth above, the above mentioned drive means can be constituted by a third pressure receiving chamber formed between the opposing end surfaces of the said first and second spools to be supplied with the pressure fluid via a path of introduction thereof formed at a corresponding position of the said valve block for driving the said second spool under a pressure of the said pressure fluid to take the said position of drain. In this case, it is preferable to construct the valve so that the pressure fluid in the above mentioned third pressure receiving chamber may be introduced Into a chamber which is independent of the above mentioned first pressure receiving chamber, that is formed by the side of the other side end surface of the above mentioned first spool, thereby cancelling the fluid pressure in the said third pressure receiving chamber for the said first spool.

Also, the above mentioned drive means can be constituted by a chamber formed adjacent to an end surface of the said second spool which is juxtaposed with the said second spring to be supplied with a pressure fluid for being brought under the influence of a fluid pressure thereof that is opposite to the fluid pressure in the above mentioned second pressure receiving chamber.

The present invention still further provides, in a fourth construction thereof, a directional control valve for reinforcing the flow of an operating fluid in a hydraulic circuit which is provided between a fluid pressure source on the one hand and a first and a second hydraulic load on the other hand for feeding and draining the operating fluid between the fluid pressure source and the hydraulic loads, the flow reinforcement directional control valve in the hydraulic circuit comprising:

a valve block having a spool bore that is formed with a first inlet port and a second inlet port which are connected to the said fluid pressure source, a first drain port for returning flows of the operating fluid discharged from the said first hydraulic load and a first outlet port which is connected to the said first hydraulic load and positioned adjacent to the said first inlet port to the said fluid pressure source, a second drain port for returning flows of the operating fluid discharged from the said second hydraulic load and a second outlet port which is connected to the said second hydraulic load and positioned adjacent to the said second inlet port to the said fluid pressure source;

a first spool that is slidably inserted into the said spool bore from a first end portion of the said spool bore for selectively establishing and blocking a communication between the said first inlet port and the said first outlet port;

a second spool that is slidably inserted into the said spool bore from a second end portion of the said spool bore for selectively establishing and blocking a communication between the said second inlet port and the said second outlet port;

a first spring for tending to urge the said first spool to take a neutral position thereof for regularly blocking a communication between the said first inlet port and the said first outlet port;

a first pressure receiving chamber that is formed by the side of an end surface of the said first spool and, when supplied with a pressurized fluid, is adapted to urge the said first spool to take a position of pressurized fluid supply thereof for establishing a communication between the said first inlet port and the said first outlet port while blocking a communication between the said first outlet port and the said first drain port;

a first drive means that is adapted to drive the said first spool to take a position of drain thereof for blocking a communication between the said first inlet port and the said first outlet port while establishing a communication between the said first outlet port and the said first drain port;

a second spring for tending to urge the said second spool to take a neutral position thereof for regularly blocking a communication between the said second inlet port and the said second port;

a second pressure receiving chamber that is formed by the side of an end surface of the said second spool and, when supplied with a pressurized fluid, is adapted to urge the said second spool to take a position of pressurized fluid supply thereof for establishing a communication between the said second inlet port and the said second outlet port while blocking a communication between the said second outlet port and the said second drain port; and a second drive means that is adapted to drive the said second spool to take a position of drain thereof for blocking a communication between the said second inlet port and the said second outlet port while establishing a communication between the said second outlet port and the said second drain port.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention will be set out, first with reference to FIGS. 1 to 6. In the following explanation, it should be noted that the details of various elements involved in these embodiments will be set out in order to aid in gaining a complete understanding of the present invention. It will be obvious to a person skilled in the art, however, that the present invention can be practiced without using such detailedly explained constructions. Moreover, the detailed explanation that relates to a known construction is omitted in order not to make a construction of the present invention unnecessarily vague.

Figure 1:
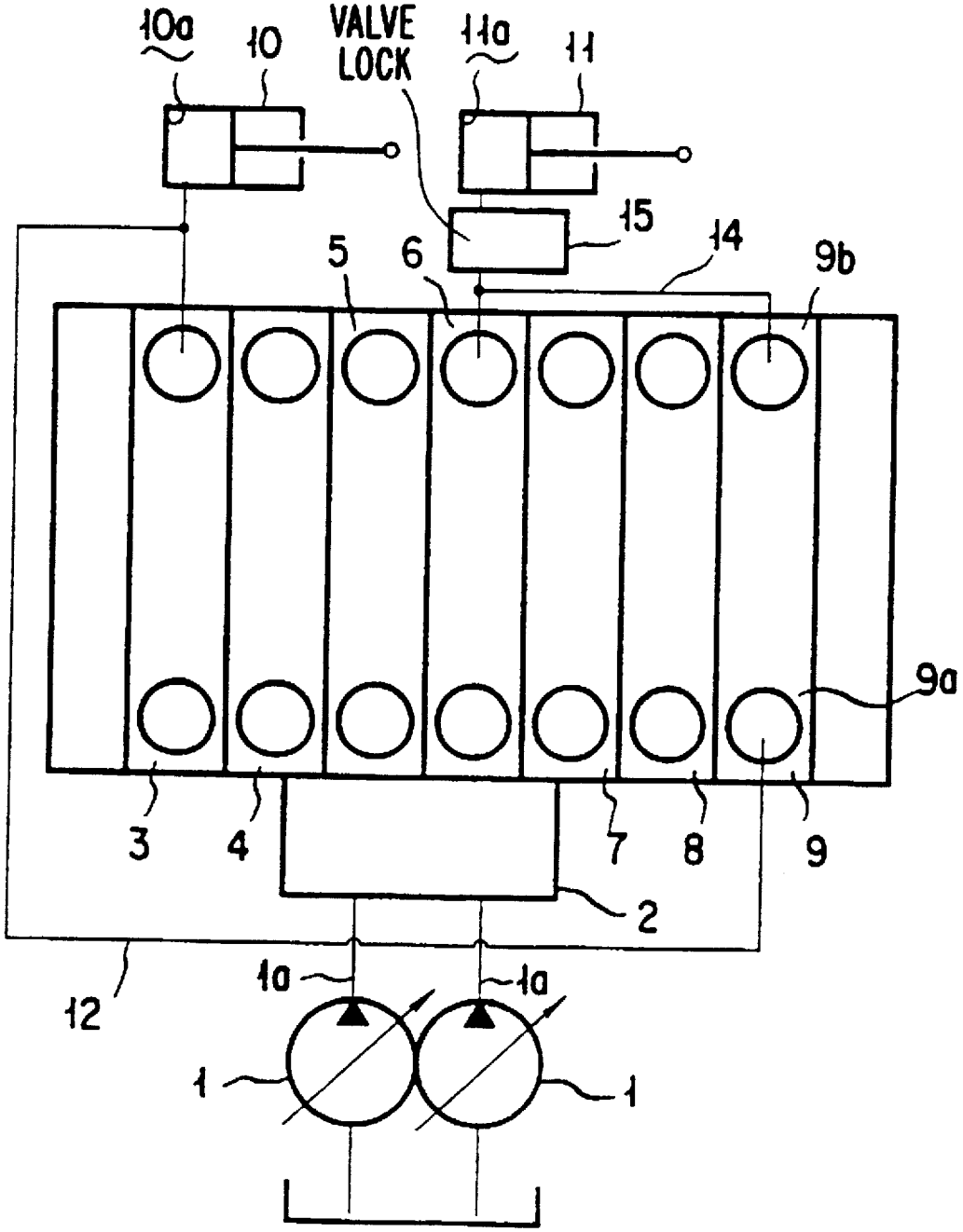
FIG. 1 is an overall diagrammatic view illustrating a suitable embodiment of the pressurized fluid supply unit according to the present invention.

As shown in FIG. 1, the respective discharge paths 1*a* and 1*a* of a pair of hydraulic pumps 1 and 1 are connected via a merging valve 2 to the respective inlets of a directional control valve 3 for arm, a left hand side traveling purpose directional control valve 4, a turning purpose directional control valve 5, a directional control valve 6 for boom, a right hand side traveling purpose directional directional control valve and a directional control valve 8 for bucket and further a flow reinforcement directional control valve 9 according to the present invention. Thus, a pressurized fluid is supplied via these directional control valves to an arm cylinder 10, a left hand side traveling motor, a turning motor, a boom cylinder 11, a right hand side traveling motor and a bucket cylinder, respectively.

The above mentioned flow reinforcement directional control valve 9 is provided with a portion a for arm and a portion 9*b* for boom. The portion 9*a* for arm is connected via a reinforcement circuit 12 for arm to an expanding chamber 10*a* of the arm cylinder 10, whereas the portion 9*b* for boom is connected via a reinforcement circuit 14 for boom to an expanding chamber 11*a* of the boom cylinder 11. A lock valve is designated at numeral 15.

Figure 2:
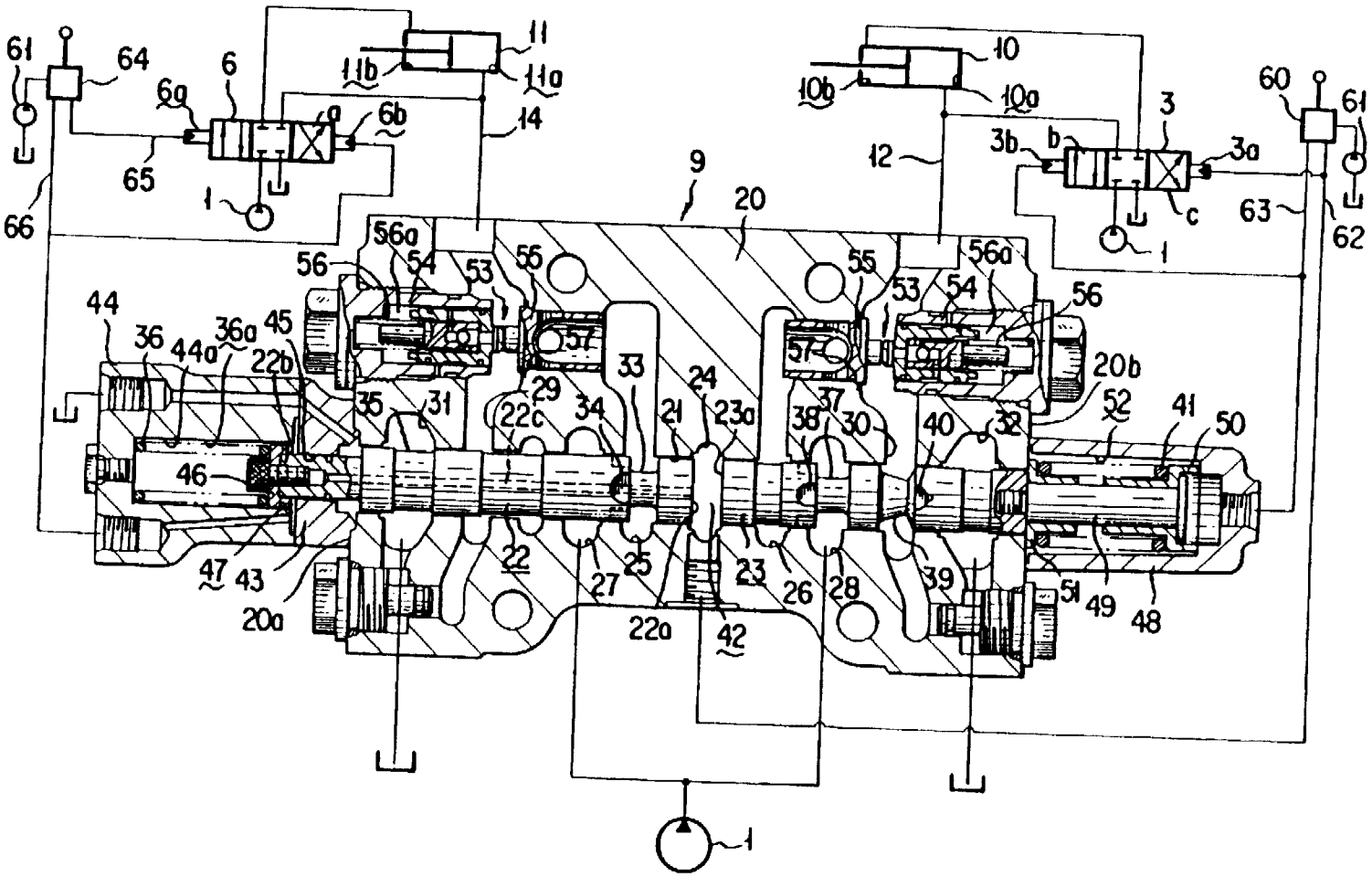
FIG. 2 is a cross sectional view illustrating a first embodiment of the flow reinforcement directional control valve according to the present invention.

The above mentioned flow reinforcement directional control valve will be described in detail with reference to FIG. 2.

In the flow reinforcement directional control valve 9, a valve block 20 has a spool bore 21 in which at a left hand side and at a right hand side thereof are slidably inserted a first spool 22 and a second spool 23, respectively. The spool bore 21 at an intermediate portion thereof between the left hand side and the right hand side is formed with an intermediate port 24. bounding on the intermediate port 24, at the left hand side and at the right hand side, respectively, there are formed a first and a second outlet port 25 and 26, a first and a second pump port 27 and 28, a first and a second actuator port 29 and 30, and a first and a second tank port 31 and 32. The first spool 22 is formed with a first small diameter portion 33 and a first recess 34 for establishing and blocking a communication between the first outlet port 25 and the first pump port 27, and with a second small diameter portion 35 for establishing and blocking a communication between the first actuator port 29 and the first tank port 31. The first spool 22 is held by a first spring 36 at its neutral position for blocking a communication between these ports. The above mentioned second spool 23 is formed with a third small diameter portion 37 and a second recess 38 for establishing and blocking a communication between the second outlet port 26 and the second pump port 28, and with a forth small diameter portion 39 and a third recess 40 for establishing and blocking a communication between the second actuator port 30 and the second tank port 32. The second spool 23 is held by a second spring 41 at its neutral position for blocking a communication between these ports.

The respective, opposing end surfaces 22*a* and 23*a* of the above mentioned first and second spools 22 and 23 are disposed to face the intermediate port 24 and to constitute therewith a first pressure receiving chamber 42, which is formed to communicate via an axial opening 22*c* of the first spool 22 with a spring chamber 36*a* enclosing the first spring 36.

A left hand side end surface 20*a* of the above mentioned valve block 20 has a spring reception cylinder 44 firmly secured thereto via a plate 43. A small diameter end portion 22*b* of the first spool 22 is formed so as to project from a bore 45 of the plate 43 into the spring reception cylinder 44, and has fixed thereto a piston 46 by bolts. The piston 46 is slidably fitted in an inner circumferential surface 44*a* of the spring reception cylinder 44 to constitute therewith the above mentioned spring chamber 36*a*. A second pressure receiving chamber 47 is formed collectively between the above mentioned piston 46, the small diameter end portion 22*b*, the spring reception cylinder 44 and the left hand side end surface 20*a* of the valve block 20 and, when supplied with a pressurized fluid, acts to move the first spool 22 via the piston 46 in a left hand side direction to reach its first position.

The above mentioned valve block 20 has at its right hand side end surface 20*b* a spring reception cylinder 48 secured thereto. A rod 49 that is provided in the spring reception cylinder 48 is connected to the second spool 23. A second spring 41 is provided between a first and a second spring receptor 50 and 51 that are formed on the rod 49 to hold the second spool 23 at its neutral position. The second spool 23 is displaced by a pressurized fluid in the above mentioned first pressure receiving chamber 42 to reach its first position. The second spool 23 is also displaced by a pressurized fluid in a third pressure receiving chamber 52 within the above mentioned spring reception cylinder 48 to reach its second position.

The above mentioned valve block 20 is provided with a left hand side and a right hand side pressure compensation valve 53 and 53. Each pressure compensation valve 53 has a poppet 55 on its valve proper 54. Each popper 55 is urged by a spring 56 against a valve seat 57 of the valve block 20 for blocking a communication between the first outlet port 25 and the first actuator port 29 and a communication between the second outlet port 26 and the second actuator port 30, respectively, to set an outlet side pressure with both a load pressure applied into a spring chamber 56*a* and an inlet pressure acting on the popper 55.

The above mentioned pressure compensation valves 53 and 53, where the actuators of varying loads are to be supplied with the pressurized fluid simultaneously, are set by both the pump discharge pressure and the highest load pressure for pressure compensation. This enables the pressurized fluid to be supplied to the actuators of varying loads at the same time. Each of the pressure compensation valves 53 is also provided in each of the above mentioned directional control valves.

An arm pilot valve 60 is provided to supply a pressurized discharge fluid from a pilot hydraulic pump 61 to a first and a second pilot circuit 62 and 63. The first pilot circuit 62 is connected both to the first pressure receiving portion 3*a* of the arming purpose directional control valve 3 and to the above mentioned first pressure receiving chamber 42, whereas the second pilot circuit 63 is connected to the second pressure receiving portion 3*b* of the directional control valve 3 and to the above mentioned third pressure receiving chamber 52.

A boom pilot valve 64 is provided to supply a pressurized discharge fluid from the pilot hydraulic pump 61 to a first and a second pilot circuit 65 and 66. The first pilot circuit 65 is connected to a first pressure receiving portion 6*a* of the directional control valve 6 for boom, whereas the second pilot circuit 66 is connected both to the second pressure receiving portion 6*b* of the directional control valve 6 and to the above mentioned second pressure receiving chamber 47.

Now, the operation will be set forth with respect to the flow reinforcement directional control valve according to the first embodiment of the present invention as mentioned in the foregoing.

When the boom cylinder 11 is expanded to turn the boom upward:

By operating the pilot valve 64, the pressurized fluid will be fed out to the second pilot circuit 66. This will cause the directional control valve 6 for boom to take its raising position a such that the pressurized discharge fluid from the hydraulic pump 1 may be fed into the expanding chamber 11*a* of the boom cylinder 11.

At the same time, the second pressure receiving chamber 47 of the flow reinforcement directional control valve 9 will be supplied with a pilot pressure fluid to thrust the first spool 22 leftwards to take its first position. This will thus establish a communication between the first pump port 27 and the first outlet port 25 via the first small diameter portion 33 and the first recess 34 while leaving a communication blocked between the first actuator port 29 and the first tank port 31. Since the pressurized discharge fluid from the hydraulic pump 1 is thereby fed through the reinforcement circuit 14 for boom to the expanding chamber 11*a* of the boom cylinder 11 via the first pump port 27, the first outlet port 25 and the first actuator port 29, the expanding chamber 11*a* of the boom cylinder 11 will be delivered with an augmented volumetric flow.

When the arm cylinder 10 is expanded to turn the arm downward for an excavation operation:

By operating the arm pilot valve 60, the pilot pressure fluid will be fed out into the second pilot circuit 63. This will cause the directional control valve 3 for arm to take its first position b such that the pressurized discharge fluid from the hydraulic pump 1 may be fed into the expanding chamber 10*a* of the arm cylinder 10.

At the same time, the third pressure receiving chamber 52 of the flow reinforcement directional control valve 9 will be supplied with a pilot pressure fluid to thrust the second spool 23 leftwards to take its first position. This will thus establish a communication between the second pump port 28 and the second outlet port 26 while leaving a communication blocked between the second actuator port 30 and the second tank port 32. Since the pressurized discharge fluid from the hydraulic pump 1 is thereby fed through the reinforcement circuit 12 for arm to the expanding chamber 10*a* of the arm cylinder 10 via the second pump port 28, the second outlet port 26 and the second actuator port 30, the expanding chamber 10*a* of the arm cylinder 10 will be delivered with an augmented volumetric flow.

When the arm cylinder 10 is contracted to turn the arm upward for a dumping operation:

By operating the arm pilot valve 60, the pilot pressure fluid will be fed out into the first pilot circuit 62.

This will cause the directional control valve 3 for arm to take its second position c such that the pressurized discharge fluid from the hydraulic pump 1 may be fed into the contracting chamber 10*b* of the arm cylinder 10, with the pressurized fluid in the expanding chamber 10*a* flowing into a tank. At the same time, the first pressure receiving chamber 42 of the flow reinforcement directional control valve 9 will be supplied with a pilot pressure fluid to thrust the second spool 23 rightwards to take its first position. This will thus leave a communication blocked between the second pump port 28 and the second outlet port 26 while establishing a communication between the second actuator port 30 and the second tank port 32 via the fourth small diameter portion 39 and the third recess 40. Since the pressurized discharge fluid in the expanding chamber 10*a* of the arm cylinder 10 thereby flows out into the tank via the second actuator port 30 and the second tank port 32, an augmented volumetric flow will be delivered into the tank out of the expanding chamber 10*a* of the arm cylinder 10.

At this instant, since the pilot pressure fluid supplied to the first pressure receiving chamber 42 is delivered into the spring chamber 36*a* via the axial opening 22*c* of the first spool 22, no leftward or rightward displacement will be effected for the first spool 22.

Figure 3:
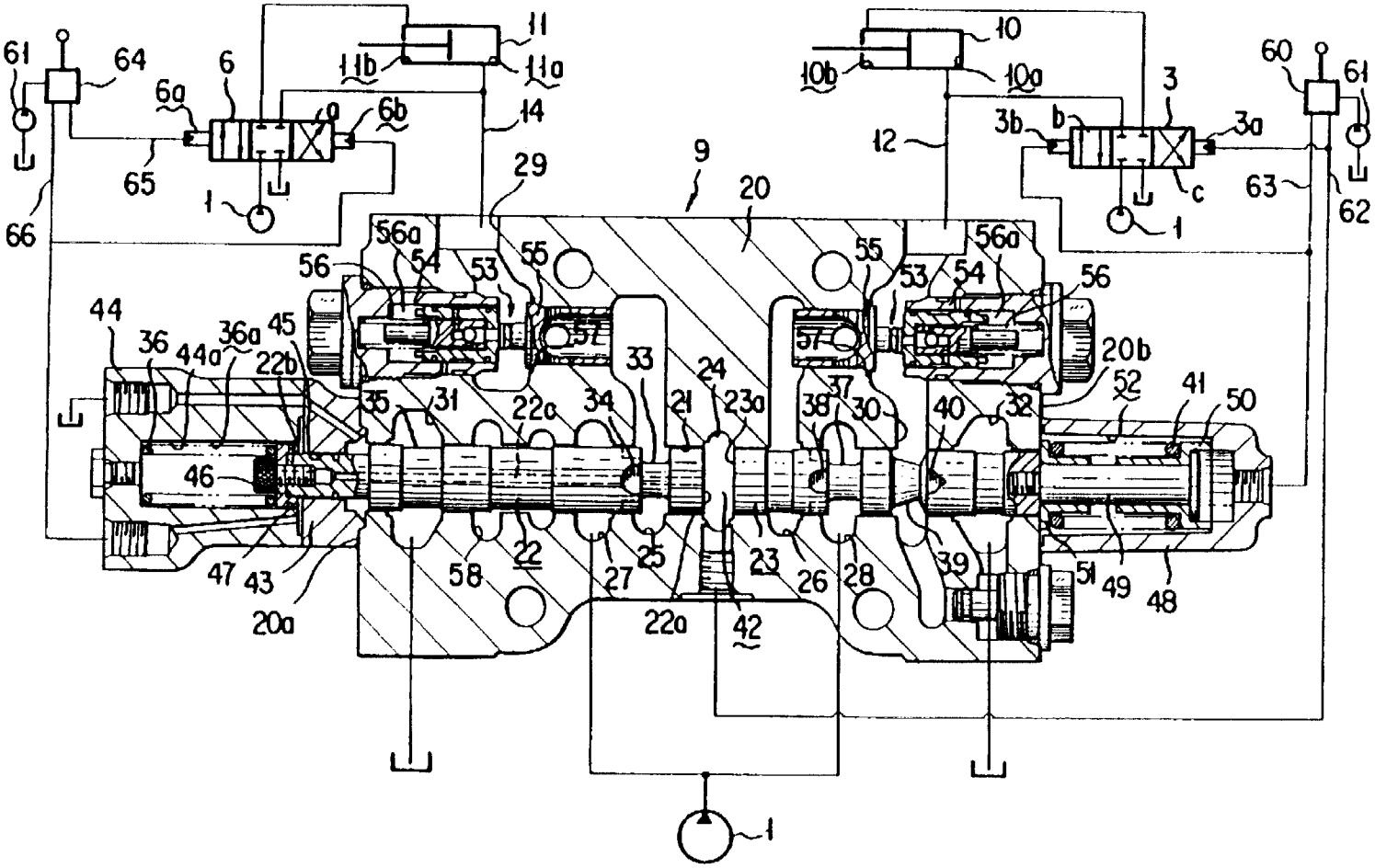
FIG. 3 is a cross sectional view illustrating a second embodiment of the flow reinforcement directional control valve according to the present invention.

FIG. 3 shows a second embodiment of the flow reinforcement directional control valve according to the present invention. In this embodiment, the first actuator port 29 and the passage 58 are disconnected from each other and the valve is so configured that by means of the popper 55, no pressure fluid may flow from the first actuator port 29 to the first outlet port 25.

With the valve so constructed, since the pressurized fluid in the expanding chamber 11*a* of the boom cylinder 11 does not flow out into the tank through an interstice between the spool bore 21 and the first spool 22, the possibility that the boom cylinder may be contracted by an external force to allow the boom to turn downward spontaneously can be minimized and at the same time the lock valve 15 shown in FIG. 1 can be omitted.

As the said first spool 22 is displaced, a first particular actuator can be supplied with the said pressurized fluid. And, as the said second spool 23 is displaced, a second particular actuator can be supplied with the said pressurized fluid. And yet, since the said first spool 22 and the said second spool 23 are provided in a said single valve block 20, the unit can be made compact.

Further, as the said second spool 23 is displaced to the said second position thereof, a return fluid from the second particular actuator can be caused to flow into a tank, thus enabling a large volumetric flow from the second particular actuator to flow out into the tank, hence permitting the said second particular actuator to be operated smoothly.

Figure 4:
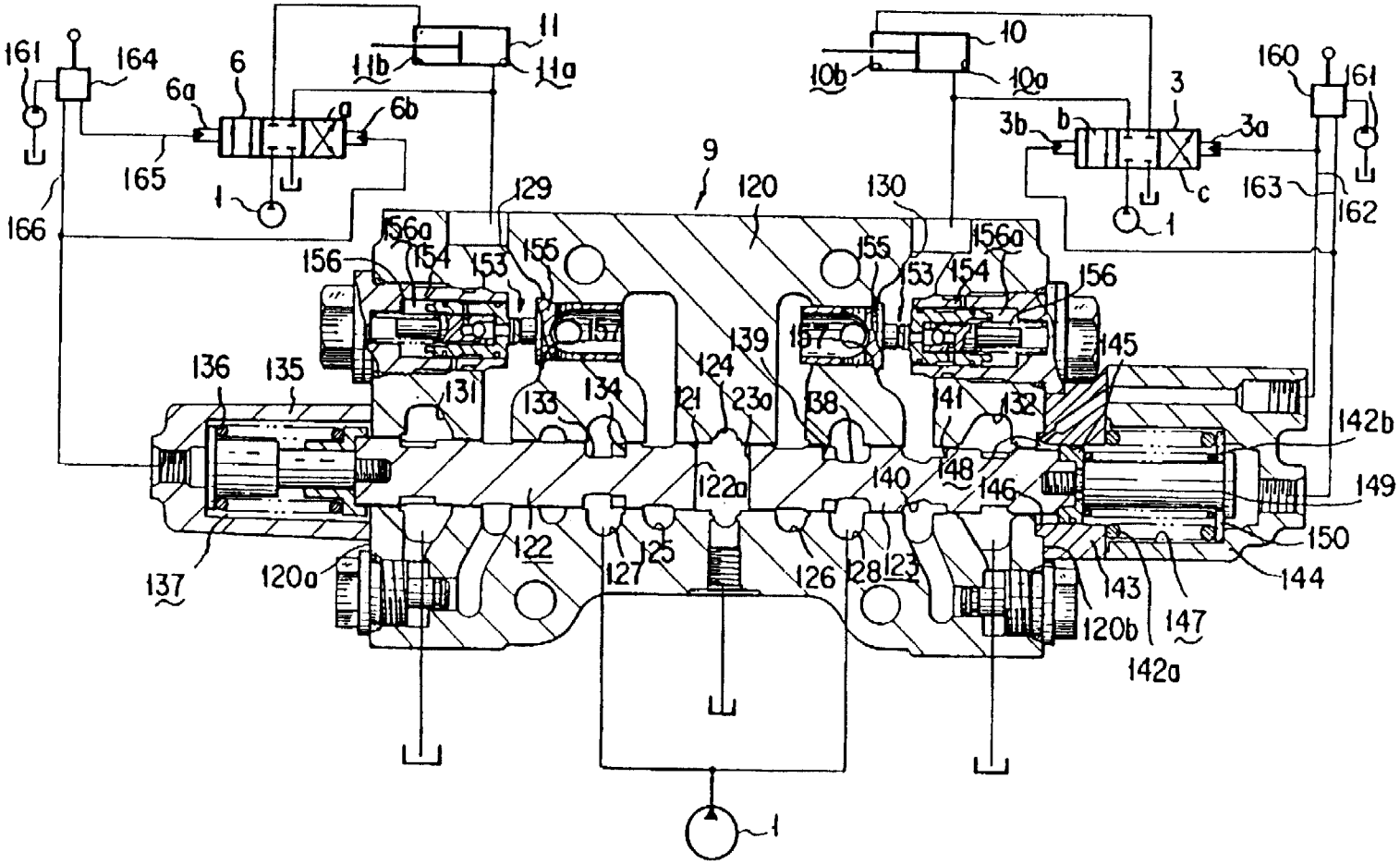
FIG. 4 is a cross sectional view illustrating a third embodiment of the flow reinforcement directional control valve according to the present invention.

FIG. 4 shows, in detail, a third embodiment of the flow reinforcement directional control valve 9 according to the present invention. A valve block 120 has a spool bore 121 in which at a left hand side and at a right hand side thereof are slidably inserted a first spool 122 and a second spool 123, respectively. The spool bore 121 at an intermediate portion thereof between the left hand side and the right hand side is formed with an intermediate port 124. Bounding on the intermediate port 124, at the left hand side and at the right hand side, respectively, there are formed a first and a second outlet port 125 and 126, a first and a second pump port 127 and 128, a first and a second actuator port 129 and 130, and a first and a second tank port 131 and 132, respectively. The first spool 122 1s formed with a first small diameter portion 133 and a first recess 134 for establishing and blocking a communication between the first outlet port 125 and the first pump port 127. The first spool 122 is held by a first spring 136 disposed in a spring reception cylinder 135 secured to a left hand side end face 120*a* of the valve block 120 at a neutral position thereof for blocking a communication between these ports, and is thrusted rightwards by a pressurized fluid in a first pressure receiving chamber 137 formed in the spring reception cylinder 135 to take a first position thereof. The second spool 123 is formed with a second small diameter portion 138 and a second recess 139 for establishing and blocking a communication between the second outlet port 126 and the second pump port 128, and with a third small diameter portion 140 and a third recess 141 for establishing and blocking a communication between the second actuator port 130 and the second tank port 132. The second spool 123 is held by a second spring 142*a* and a third spring 142*b* at its neutral position for blocking a communication between these ports.

The respective, opposing end surfaces 122*a* and 123*a* of the above mentioned first and second spools 122 and 123 are disposed to face the intermediate port 124, which is arranged to communicate with a tank.

A right hand side end surface 120*b* of the above mentioned valve block 120 has a spring reception cylinder 144 firmly secured thereto via a plate 143. One end portion of the second spool 123 has a piston 145 fixed thereto by bolts. The piston 145 is slidably fitted in a bore 146 of the plate 143 to constitute therewith a second pressure chamber 147 in the above mentioned spring reception cylinder 144. The second spool 123 is thrusted leftwards by a pressurized fluid in the above mentioned second pressure receiving chamber 147 to take its first position. A third annular pressure receiving chamber 148 is formed collectively between an end portion of the above mentioned piston 145, the bore 146 of the plate 143 and the right hand side end surface **120*b* of the valve block 120 and, when supplied with a pressurized fluid, acts to move the second spool 123 via the piston 145** in a right hand side direction to reach its second position.

A rod 149 that is provided in the spring reception cylinder 144 is connected to the second spool 23. The second spring **142*a* is provided between a spring receptor 150 formed on the rod 149 and the plate 143 whereas the third spring 142*b* is provided between the spring receptor 150 and the piston 145 to hold the second spool 123** at its neutral position.

The above mentioned valve block 120 is provided with a left hand side and a right hand side pressure compensation valve 153 and 153. Each pressure compensation valve 153 has a popper 155 on its valve proper 154. Each popper 155 is urged by a spring 156 against a valve seat 157 of the valve block 120 for blocking a communication between the first outlet port 125 and the first actuator port 129 and a communication between the second outlet port 126 and the second actuator port 130, respectively, to set an outlet side pressure with both a load pressure applied into a spring chamber **156*a* and an inlet pressure acting on the poppet 155**.

The above mentioned pressure compensation valves 153 and 153, where the actuators of varying loads are to be supplied with the pressurized fluid simultaneously, are set by both the pump discharge pressure and the highest load pressure for pressure compensation. This enables the pressurized fluid to be supplied to the actuators of varying loads at the same time. Each of the pressure compensation valves 153 is also provided in each of the above mentioned directional control valves.

An arm pilot valve 160 is provided to supply a pressurized discharge fluid from a pilot hydraulic pump 161 to a first and a second pilot circuit 162 and 163. The first pilot circuit 162 is connected both to the first pressure receiving portion **103*a* of the arming purpose directional control valve 103 and to the above mentioned third pressure receiving chamber 148, whereas the second pilot circuit 163 is connected both to the second pressure receiving portion 103*b* of the directional control valve 103 and to the above mentioned second pressure receiving chamber 147**.

A boom pilot valve 164 is provided to supply a pressurized discharge fluid from the pilot hydraulic pump 161 to a first and a second pilot circuit 165 and 166. The first pilot circuit 165 is connected to a first pressure receiving portion **6*a* of the directional control valve 6 for boom, whereas the second pilot circuit 166 is connected both to the second pressure receiving portion 6b of the directional control valve 6 and to the above mentioned first pressure receiving chamber 137**.

Now, the operation will be set forth with respect to the third embodiment of the flow reinforcement directional control valve according to the present invention.

When the boom cylinder 11 is expanded to turn the boom upward:

By operating the pilot valve 164, the pressurized fluid will be fed out to the second pilot circuit 166. This will cause the directional control valve 6 for boom to take its raising position a such that the pressurized discharge fluid from the hydraulic pump 1 may be fed into the expanding chamber **11*a* of the boom cylinder 11**.

At the same time, the first pressure receiving chamber 137 of the flow reinforcement directional control valve 9 will be supplied with a pilot pressure fluid to thrust the first spool 122 rightwards to take its first position. This will thus establish a communication between the first pump port 127 and the first outlet port 125 via the first small diameter portion 133 and the first recess 134 while leaving a communication blocked between the first actuator port 129 and the first tank port 131. Since the pressurized discharge fluid from the hydraulic pump 1 is thereby fed to the expanding chamber **11*a* of the boom cylinder 11 via the first pump port 127, the first outlet port 125 and the first actuator port 129, the expanding chamber 11*a* of the boom cylinder 11** will be delivered with an augmented volumetric flow.

When the arm cylinder 10 is expanded to turn the arm downward for an excavation operation:

By operating the arm pilot valve 160, the pilot pressure fluid will be fed out into the second pilot circuit 163. This will cause the arming directional control valve 3 for arm to take its first position b such that the pressurized discharge fluid from the hydraulic pump 1 may be fed into the expanding chamber **10*a* of the arm cylinder 10**.

At the same time, the second pressure receiving chamber 147 of the flow reinforcement directional control valve 9 will be supplied with a pilot pressure fluid to thrust the second spool 123 leftwards to take its first position. This will thus establish a communication between the second pump port 128 and the second outlet port 126 while leaving a communication blocked between the second actuator port 130 and the second tank port 132. Since the pressurized discharge fluid from the hydraulic pump 1 is thereby fed to the expanding chamber 10a of the arm cylinder 10 via the second pump port 128, the second outlet port 126 and the second actuator port 130, the expanding chamber **10*a* of the arm cylinder 10** will be delivered with an augmented volumetric flow.

When the arm cylinder 10 is contracted to turn the arm upward for a dumping operation:

By operating the arm pilot valve 160, the pilot pressure fluid will be fed out into the first pilot circuit 162. This will cause the directional control valve 3 for arm to take its second position c such that the pressurized discharge fluid from the hydraulic pump 1 may be fed into the contracting chamber **10*b* of the arm cylinder 10, with the pressurized fluid in the expanding chamber 10*a*** flowing into a tank.

At the same time, the third pressure receiving chamber 148 of the flow reinforcement directional control valve 9 will be supplied with a pilot pressure fluid to thrust the second spool 123 rightwards to take its second position. This will thus leave a communication blocked between the second pump port 128 and the second outlet port 126 while establishing a communication between the second actuator port 130 and the second tank port 132 via the third small diameter portion 140 and the third recess 141. Since the pressurized discharge fluid in the expanding chamber **10*a* of the arm cylinder 10 thereby flows out into the tank via the second actuator port 130 and the second actuator 132, an augmented volumetric flow will be delivered into the tank out of the expanding chamber 10*a* of the arm cylinder 10**.

Figure 5:
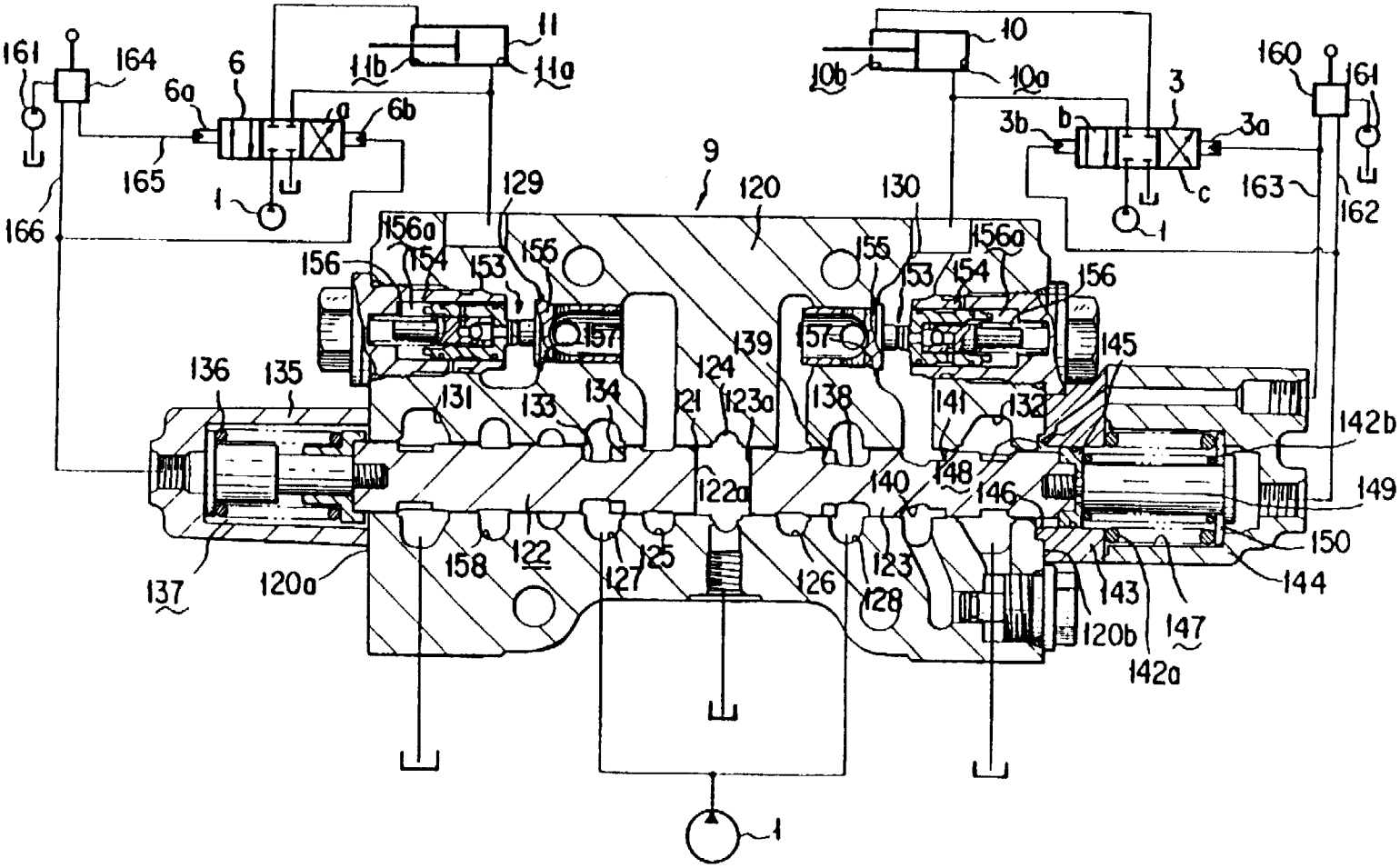
FIG. 5 is a cross sectional view illustrating a fourth embodiment of the flow reinforcement directional control valve according to the present invention.

FIG. 5 shows a fourth embodiment of the flow reinforcement directional control valve according to the present invention. The first actuator port 129 and the passage 158 are disconnected from each other and the valve is so configured that by means of the poppet 155, no pressure fluid may flow from the first actuator port 129 to the first outlet port 125. With the valve so constructed, since the pressurized fluid in the expanding chamber 11*a* of the boom cylinder 11 does not flow out into the tank through an interstice between the spool bore 121 and the first spool 122, the possibility that the boom cylinder 11 may be contracted by an external force to allow the boom to turn downward spontaneously can be minimized and at the same time the lock valve 15 shown in FIG. 1 can be omitted.

As the said first spool 122 is displaced, a first particular actuator can be supplied with the said pressurized fluid. And, as the said second spool 123 is displaced, a second particular actuator can be supplied with the said pressurized fluid. And yet, since the said first spool 122 and the said second spool 123 are provided in a said single valve block 120, the unit can be made compact.

Further, as the said second spool 123 is displaced to the said second position thereof, a return fluid from the second particular actuator can be caused to flow into a tank, thus enabling a large volumetric flow from the second particular actuator to flow out into the tank, hence permitting the said second particular actuator to be operated smoothly. Also, by virtue of the fact that the switching unit for the said second spool is installed at the side of the said first spool, the flow reinforcement directional control valve is made capable of establishing and blocking a communication between a said pump port and a said actuator port and a communication between a said actuator port and a said tank port, together with the said first and second spool.

Also, since the said first, second and third pressure receiving chambers 137, 147 and 148 for displacing the said first and second spools 122 and 123 are formed at the sides of the said springs disposed at the said left hand side and said right hand side, such conduits as for supplying the pressurized fluid to the said first, second and third pressure receiving chambers 137, 147 and 148 may simply be provided towards the said left hand side and the said right hand side and, where they are connected to other directional control valves, may act similarly to those in these directional control valves and hence allows a conduit arranging operation to be readily performed.

Figure 6:
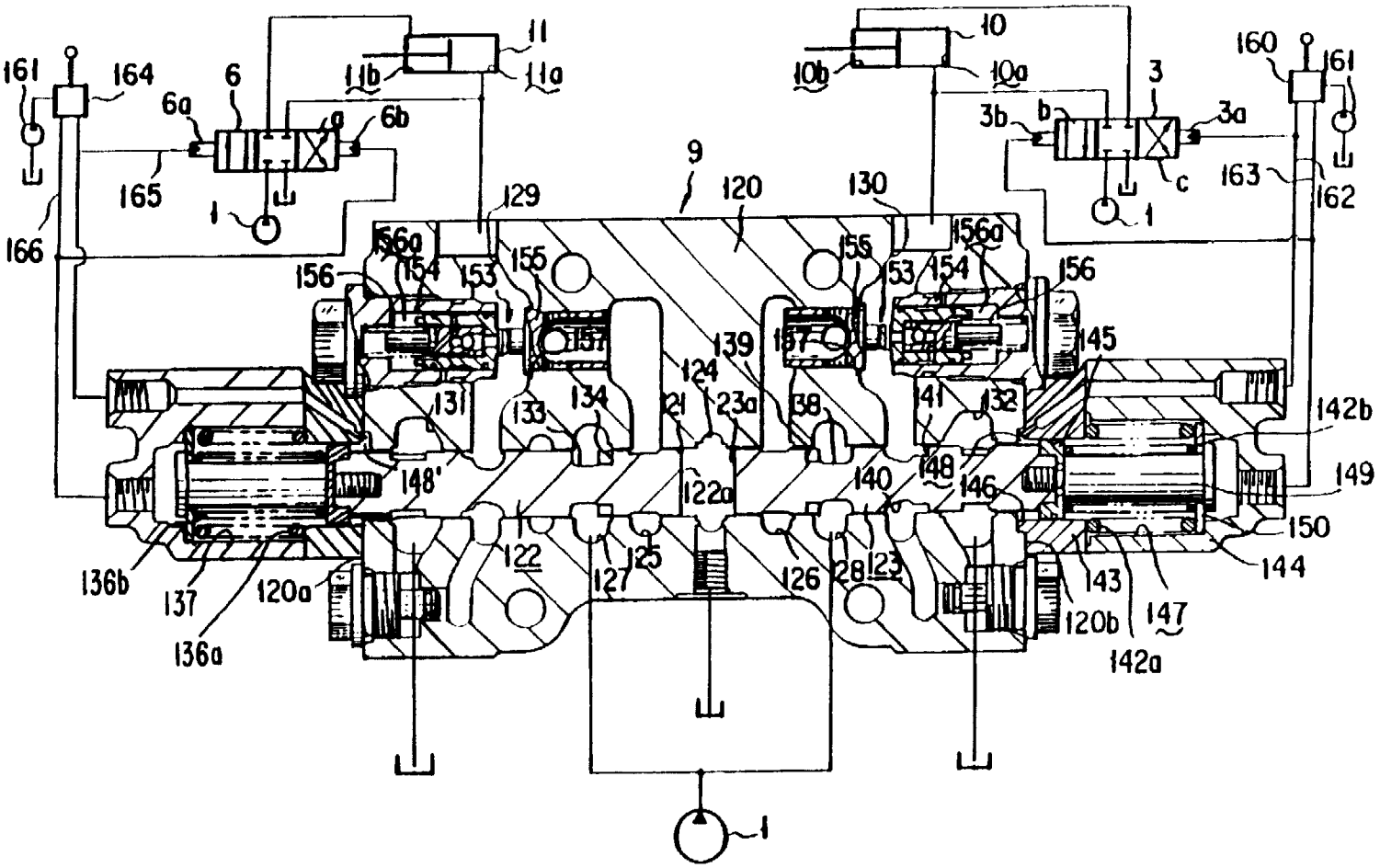
FIG. 6 is a cross sectional view illustrating a fifth embodiment of the flow reinforcement directional control valve according to the present invention.

FIG. 6 shows a fifth embodiment of the flow reinforcement directional control valve 9 according to the present invention. This embodiment includes a drive means adapted to drive the first spool 122 into a drain position for blocking a communication between the first inlet port 127 and the first outlet port 125, 129 while establishing a communication between the first outlet port 129 and the first drain port 131. The drive means is constituted by a first annular chamber 148' formed adjacent to an end surface of the first spool 122 which is juxtaposed with a first spring arrangement 136*a*, 136*b*. When the chamber 148' is supplied with a pressure fluid from the first pilot circuit 165, the chamber 148' is brought under the influence of a fluid pressure that urges the spool 122 in a leftward direction, as seen in FIG. 6. Thus, in this embodiment, both the right and left sides of the directional control valve 9 have a drive means for moving the respective spools 122, 123 to a drain position where the outlet ports 129, 130 are communicated with the drain ports 131, 132, respectively.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A flow reinforcement directional control valve which is so constructed that a valve block has a spool bore in which at a left hand side and at a right hand side thereof a first spool and a second spool are slidably inserted, respectively; which at an intermediate portion thereof between said left hand and right hand sides is formed with an intermediate port to form a first pressure receiving chamber positioned between opposing end surfaces of said first and second spools; which is formed with a first pump port and a first actuator port that are adapted to be connected to and disconnected from each other by said first spool; which is formed with a second pump port, a second actuator port and a second tank port that are adapted to be connected to and disconnected from one another by said second spool;

in which spool bore said first spool is adapted to be held at a neutral position thereof by a first spring for blocking a communication between said ports, and to be displaced to a first position thereof by a pressurized fluid in a second pressure receiving chamber for establishing a communication between said first pump port and said first actuator port while communicating the said first pressure receiving chamber with a left hand end chamber of said first spool so that said spool may not be influenced by a pressure in said first pressure receiving chamber; and in which spool bore said second spool is adapted to be held at a neutral position thereof by a second spring for blocking a communication between said ports, to be displaced to a first position thereof by a pressurized fluid in a third pressure receiving chamber for establishing a communication between said second pump port and said second actuator port while blocking a communication between said second actuator port and said second tank port, and to be displaced to a second position thereof by a pressurized fluid in said first pressure receiving chamber for establishing a communication between said second actuator port and said second tank port while blocking a communication between said second actuator port and said second pump port.

2. A flow reinforcement directional control valve which is so constructed that a valve block has a spool bore in which at a left hand side and at a right hand side thereof a first spool and a second spool are slidably inserted, respectively; which is formed with a first pump port and a first actuator port that are adapted to be connected to and disconnected from each other by said first spool; which is formed with a second pump port, a second actuator port and a second tank port that are adapted to be connected to and disconnected from one another by said second spool;

in which spool bore said first spool is adapted to be held by a first spring disposed at one end portion of said left hand and right hand sides at a neutral position thereof for blocking a communication between said ports, and to be displaced by a pressurized fluid in a first pressure receiving chamber formed at a side of said first spring to a first position thereof for establishing a communication between said first pump port and said first actuator port; and in which spool bore said second spool is adapted to be held by a spring disposed at the other end portion of said left hand and right hand sides at a neutral position thereof for blocking a communication between said ports, to be displaced by a pressurized fluid in a second pressure receiving chamber formed at a side of the latter spring to a first position thereof for establishing a communication between said second pump port and said second actuator port while blocking a communication between said second actuator port and said second tank port, and to be displaced by a pressurized fluid in a third pressure receiving chamber formed at a side of said latter spring to a second position thereof for establishing a communication between said second actuator port and said second tank port while blocking a communication between said second actuator port and said second pump port.

3. A flow reinforcement directional control valve as set forth in claim 2, which is capable of establishing and blocking a communication between a said pump port and a said actuator port and a communication between a said actuator port and a said tank port, as said first spool and said second spool are displaced.

4. A directional control valve for reinforcing the flow of an operating fluid in a hydraulic circuit which is provided between a fluid pressure source on the one hand and a first and a second hydraulic load on the other hand for feeding and draining the operating fluid between the fluid pressure source and the hydraulic loads, the flow reinforcement directional control valve in the hydraulic circuit comprising:

a valve block having a spool bore that is formed with a first inlet port and a second inlet port which are connected to said fluid pressure source, a first outlet port which is connected to said first hydraulic load and positioned adjacent to said first inlet port, a second outlet port which is connected to said second hydraulic load and position adjacent said second inlet port and a drain port for returning a flow of the operating fluid to said fluid pressure source;

a first spool that is slidably inserted into said spool bore from a first end portion of said spool bore for selectively establishing and blocking a communication between said first inlet port and said first outlet port;

a second spool that is slidably inserted into said spool bore from a second end portion of said spool bore for selectively establishing and blocking a communication between said second inlet port and said second outlet port;

a first spring for tending to urge said first spool to take a neutral position thereof for regularly blocking a communication between said first inlet port and said first outlet port;

a first pressure receiving chamber that is formed by the side of an end surface of said first spool and, when supplied with a pressurized fluid, is adapted to urge said first spool to take a position of communication thereof for establishing a communication between said first inlet port and said first outlet port;

a second spring for tending to urge said second spool to take a neutral position thereof for regularly blocking a communication between said second inlet port and said second port;

a second pressure receiving chamber that is formed by the side of an end surface of said second spool and, when supplied with a pressurized fluid, is adapted to urge said second spool to take a position of pressurized fluid supply thereof for establishing a communication between said second inlet port and said second outlet port while blocking a communication between said second outlet port and said drain port; and a drive means that is adapted to drive said second spool to take a position of drain thereof for blocking a communication between said second inlet port and said second outlet port while establishing a communication between said second outlet port and said drain port;

wherein said drive means is constituted by a third pressure receiving chamber formed between the opposing end surfaces of said first and second spools to be supplied with a pressure fluid via a path of introduction thereof formed at a corresponding position of said valve block for driving said second spool under a pressure of said pressure fluid to take said position of drain.

5. A flow reinforcement directional control valve as set forth in claim 4, in which the pressure fluid in said third pressure receiving chamber is introduced into a chamber which is independent of said first pressure receiving chamber, that is formed by the side of the other side end surface of said first spool, thereby cancelling the fluid pressure in said third pressure receiving chamber for said first spool.

6. A directional control valve for reinforcing the flow of an operating fluid in a hydraulic circuit which is provided between a fluid pressure source on the one hand and a first and a second hydraulic load on the other hand for feeding and draining the operating fluid between the fluid pressure source and the hydraulic loads, the flow reinforcement directional control valve in the hydraulic circuit comprising:

a valve block having a spool bore that is formed with a first inlet port and a second inlet port which are connected to said fluid pressure source, a first outlet port which is connected to said first hydraulic load and positioned adjacent to said first inlet port, a second outlet port which is connected to said second hydraulic load and position adjacent said second inlet port and a drain port for returning a flow of the operating fluid to said fluid pressure source;

a first spool that is slidably inserted into said spool bore from a first end portion of said spool bore for selectively establishing and blocking a communication between said first inlet port and said first outlet port;

a second spool that is slidably inserted into said spool bore from a second end portion of said spool bore for selectively establishing and blocking a communication between said second inlet port and said second outlet port;

a first spring for tending to urge said first spool to take a neutral position thereof for regularly blocking a communication between said first inlet port and said first outlet port;

a first pressure receiving chamber that is formed by the side of an end surface of said first spool and, when supplied with a pressurized fluid, is adapted to urge said first spool to take a position of communication thereof for establishing a communication between said first inlet port and said first outlet port;

a second spring for tending to urge said second spool to take a neutral position thereof for regularly blocking a communication between said second inlet port and said second port;

a second pressure receiving chamber that is formed by the side of an end surface of said second spool and, when supplied with a pressurized fluid, is adapted to urge said second spool to take a position of pressurized fluid supply thereof for establishing a communication between said second inlet port and said second outlet port while blocking a communication between said second outlet port and said drain port; and a drive means that is adapted to drive said second spool to take a position of drain thereof for blocking a communication between said second inlet port and said second outlet port while establishing a communication between said second outlet port and said drain port;

wherein said drive means is constituted by a chamber formed adjacent to an end surface of said second spool which is juxtaposed with said second spring to be supplied with a pressure fluid for being brought under the influence of a fluid pressure thereof that is opposite to the fluid pressure in said second pressure receiving chamber.

7. A directional control valve for reinforcing the flow of an operating fluid in a hydraulic circuit which is provided between a fluid pressure source on the one hand and a first and a second hydraulic load on the other hand for feeding and draining the operating fluid between the fluid pressure source and the hydraulic loads, the flow reinforcement directional control valve in the hydraulic circuit comprising:

a valve block having a spool bore that is formed with a first inlet port and a second inlet port which are connected to said fluid pressure source, a first drain port for returning flows of the operating fluid discharged from said first hydraulic load and a first outlet port which is connected to said first hydraulic load and positioned adjacent to said first inlet port to said fluid pressure source, a second drain port for returning flows of the operating fluid discharged from said second hydraulic load and a second outlet port which is connected to said second hydraulic load and positioned adjacent to said second inlet port to said fluid pressure source;

a first spool that is slidably inserted into said spool bore from a first end portion of said spool bore for selectively establishing and blocking a communication between said first inlet port and said first outlet port;

a second spool that is slidably inserted into said spool bore from a second end portion of said spool bore for selectively establishing and blocking a communication between said second inlet port and said second outlet port;

a first spring for tending to urge said first spool to take a neutral position thereof for regularly blocking a communication between said first inlet port and said first outlet port;

a first pressure receiving chamber that is formed by the side of an end surface of said first spool and, when supplied with a pressurized fluid, is adapted to urge said first spool to take a position of pressurized fluid supply thereof for establishing a communication between said first inlet port and said first outlet port while blocking a communication between said first outlet port and said first drain port;

a first drive means that is adapted to drive said first spool to take a position of drain thereof for blocking a communication between said first inlet port and said first outlet port while establishing a communication between said first outlet port and said first drain port;

a second spring for tending to urge said second spool to take a neutral position thereof for regularly blocking a communication between said second inlet port and said second port;

a second pressure receiving chamber that is formed by the side of an end surface of said second spool and, when supplied with a pressurized fluid, 1s adapted to urge said second spool to take a position of pressurized fluid supply thereof for establishing a communication between said second inlet port and said second outlet port while blocking a communication between said second outlet port and said second drain port; and a second drive means that is adapted to drive said second spool to take a position of drain thereof for blocking a communication between said second inlet port and said second outlet port while establishing a communication between said second outlet port and said second drain port.

8. A flow reinforcement directional control valve as set forth in claim 7, in which said second drive means is constituted by a third pressure receiving chamber formed between the opposing end surfaces of said first and second spools, is adapted to be supplied with a pressure fluid via a path of introduction thereof formed at a corresponding position of said valve block for driving said second spool under a pressure of said pressure fluid to take said position of drain.

9. A flow reinforcement directional control valve as set forth in claim 7, in which said first drive means comprises a first annular chamber which is formed adjacent to an end surface of said first spool which is juxtaposed with said first spring and, when supplied with a pressure fluid, is brought under the influence of a fluid pressure thereof that is opposite to the fluid pressure in said first pressure receiving chamber, and said second drive means comprises a second annular chamber which is formed adjacent to an end surface of said second spool which is juxtaposed with said second spring and, when supplied with a pressure fluid, is brought under the influence of a fluid pressure thereof that is opposite to the fluid pressure in said second pressure receiving chamber.

10. A flow reinforcement directional control valve as set forth in claim 7, wherein said second drive means comprises a second annular chamber which is formed adjacent to an end surface of said second spool which is juxtaposed with said second spring and, when supplied with a pressure fluid, is brought under the influence of a fluid pressure that urges the second spool in an opposite direction relative to a direction urged by the fluid pressure in said second pressure receiving chamber.

* * * * *